US007445301B1

(12) United States Patent
Smith

(10) Patent No.: US 7,445,301 B1
(45) Date of Patent: Nov. 4, 2008

(54) METHOD OF INSTALLING DRAWER SLIDES

(76) Inventor: Mark Evan Smith, 1258 Nelson Ridge Rd., Columbus, IN (US) 47201

( * ) Notice: Subject to any disclaimer, the term of this patent is extended or adjusted under 35 U.S.C. 154(b) by 0 days.

(21) Appl. No.: 11/811,406

(22) Filed: Jun. 11, 2007

(51) Int. Cl.
*A47B 97/00* (2006.01)

(52) U.S. Cl. ..... 312/352

(58) Field of Classification Search ..... 312/352, 312/330.1, 334.1, 334.4, 334.5, 350; 248/200, 248/205.1, 205.2, 205.3, 206.5
See application file for complete search history.

(56) References Cited

U.S. PATENT DOCUMENTS 3,750,993 A * 8/1973 Read ..... 248/298.1
4,244,546 A * 1/1981 Mertes et al. ..... 248/258
5,794,903 A * 8/1998 Peterson, II ..... 248/300
6,695,420 B2 * 2/2004 Ackerman ..... 312/348.4

* cited by examiner

*Primary Examiner*—James O Hansen
(74) *Attorney, Agent, or Firm*—Richard L. Huff

(57) ABSTRACT

A method for quickly installing and aligning drawer slides into articles for containing drawers. A magnetized backing strip having a magnetic laminate is attached to the rear panel of the article. Pieces of magnetized sheeting are attached to the rear ends of the mounting brackets at the rear of the drawer slides. The front ends of the drawer slides are loosely attached to the front surfaces of the drawer opening. A drawer is inserted, causing the drawer slides to assume their desired positions. When the drawer is removed, the drawer slides are held in place by magnetic force and can be attached to the desired places on the backing strips.

3 Claims, 3 Drawing Sheets

METHOD OF INSTALLING DRAWER SLIDES

CROSS-REFERENCE TO RELATED APPLICATIONS (Not applicable)

STATEMENT REGARDING FEDERALLY SPONSORED RESEARCH OR DEVELOPMENT (Not Applicable)

REFERENCE TO SEQUENTIAL LISTING, A TABLE, OR A COMPUTER PROGRAM LISTING APPENDIX SUBMITTED ON A COMPACT DISC (Not applicable)

BACKGROUND OF THE INVENTION

1) Field of the Invention

This invention is in the field of cabinetry, furniture, and casework. More particularly, this invention is in the field of installing drawer slides in cabinets, furniture, and casework.

2) Description of the Related Art

The building of cabinets requires precise measurements by skilled craftsmen. The traditional installation of drawers in the cabinets is time intensive, awkward, and often frustrating, requiring several steps. First, the cabinet is laid on its back. Then the front ends of two drawer slides are attached for each drawer. The back ends of the drawer slides having the rear end mounting brackets which touch the rear of the cabinet are free to move around. Then a drawer is inserted from above and positioned for proper placement, an estimation, since the cabinet is on its back and not in its normal upright position. Then the rear end mounting brackets are marked for location and the drawer is removed to gain access so a screw can be inserted in each bracket. Then the cabinet is returned to its normal upright position and the drawer is inserted and tested for proper alignment. If an error in alignment has occurred, a guess is made as to how much adjustment of the rear mounting brackets is necessary to correct the misalignment and the drawer is removed and the above process is repeated until the proper alignment has been accomplished. Only then are the rear mounting brackets firmly attached with more screws and the drawer finally inserted.

BRIEF SUMMARY OF THE INVENTION

The present invention relates to the installation of cabinet drawer slides wherein the drawer slide rear mounting brackets which are at the rear of the drawer slides are held to plywood strips on the rear panel of the cabinet by magnetic force enabling easy and correct placement of the drawer slides. There is a magnetic sheeting laminate on the plywood strip and a magnetic sheeting piece attached to the rear mounting bracket. During installation, the drawer slides assume the desired position when the drawer is inserted and magnetic force maintains this position, allowing the installer to quickly and accurately install the drawer slides.

DETAILED DESCRIPTION OF THE INVENTION

Figure 1:
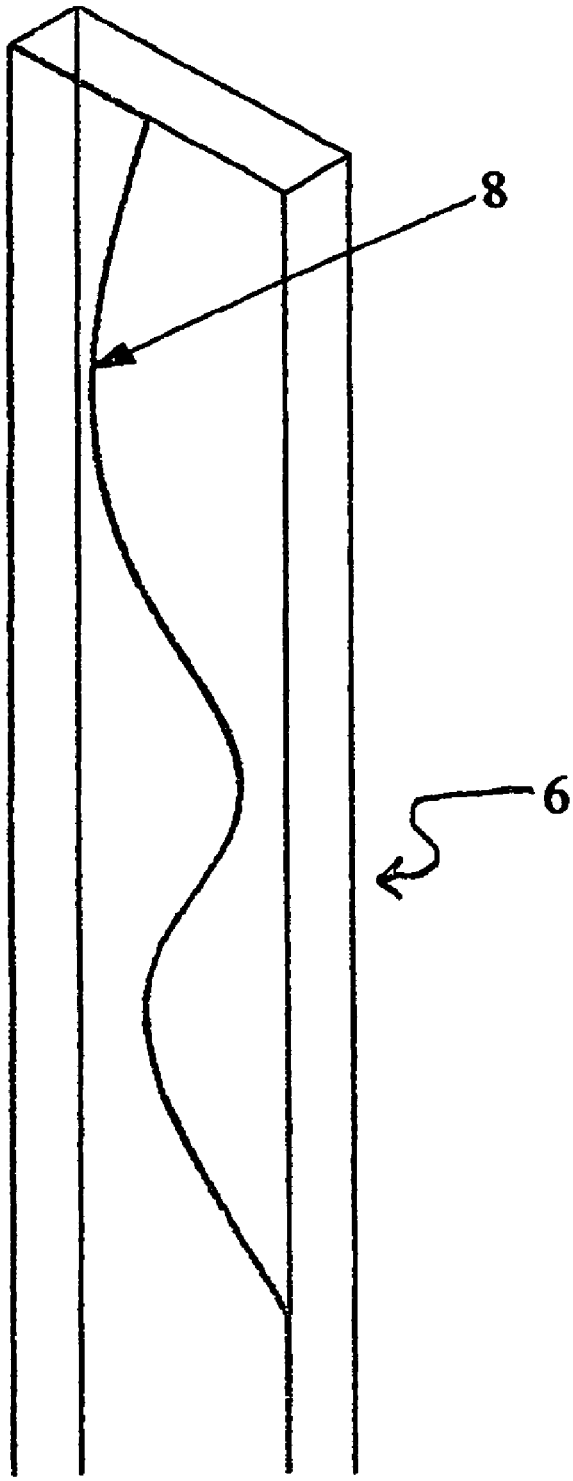
FIG. 1 is an elevational perspective view of a backing strip showing a magnetic laminate.
Figure 2:
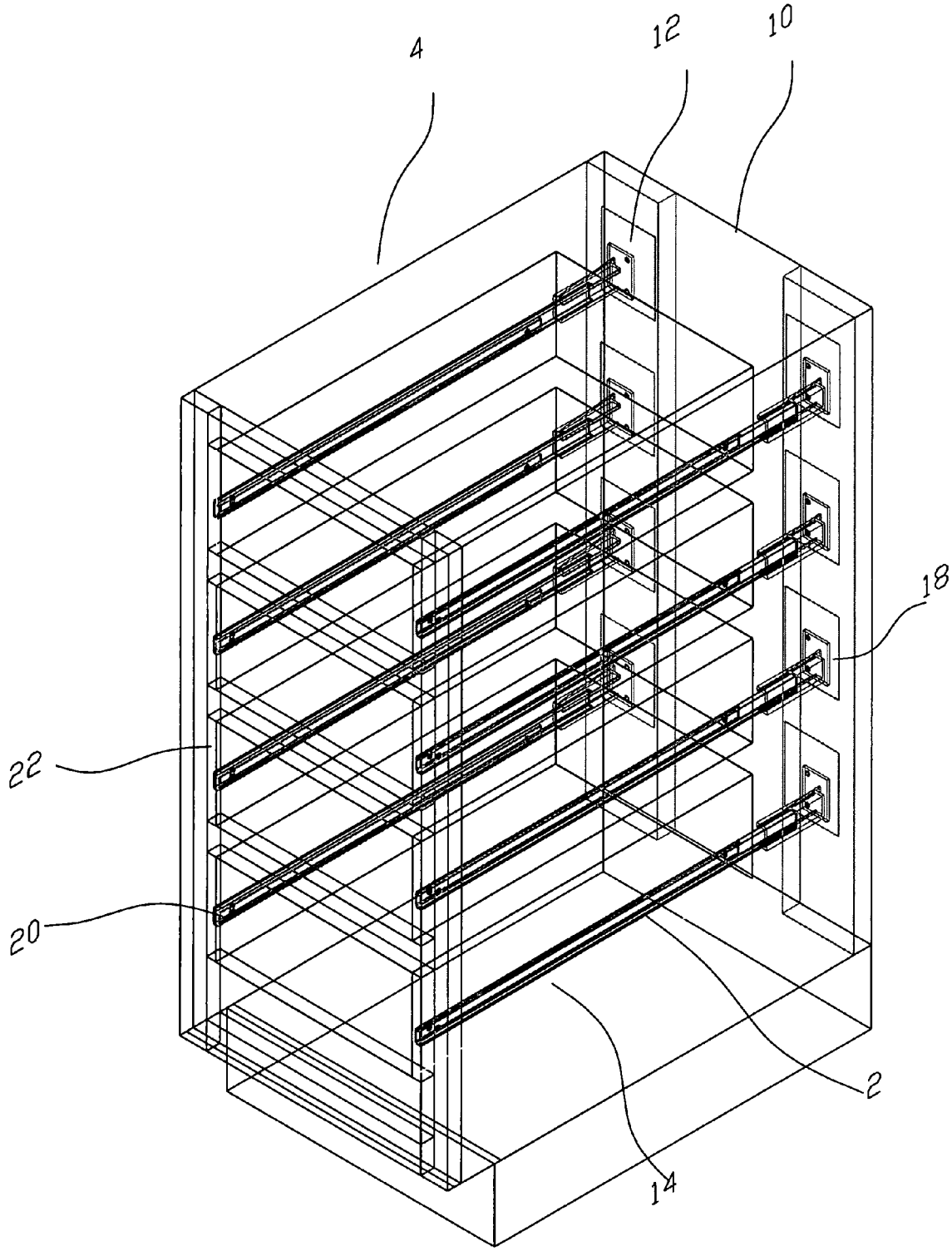
FIG. 2 is a cut-away elevational perspective view of a cabinet with the drawers and drawer slides in place.
Figure 3:
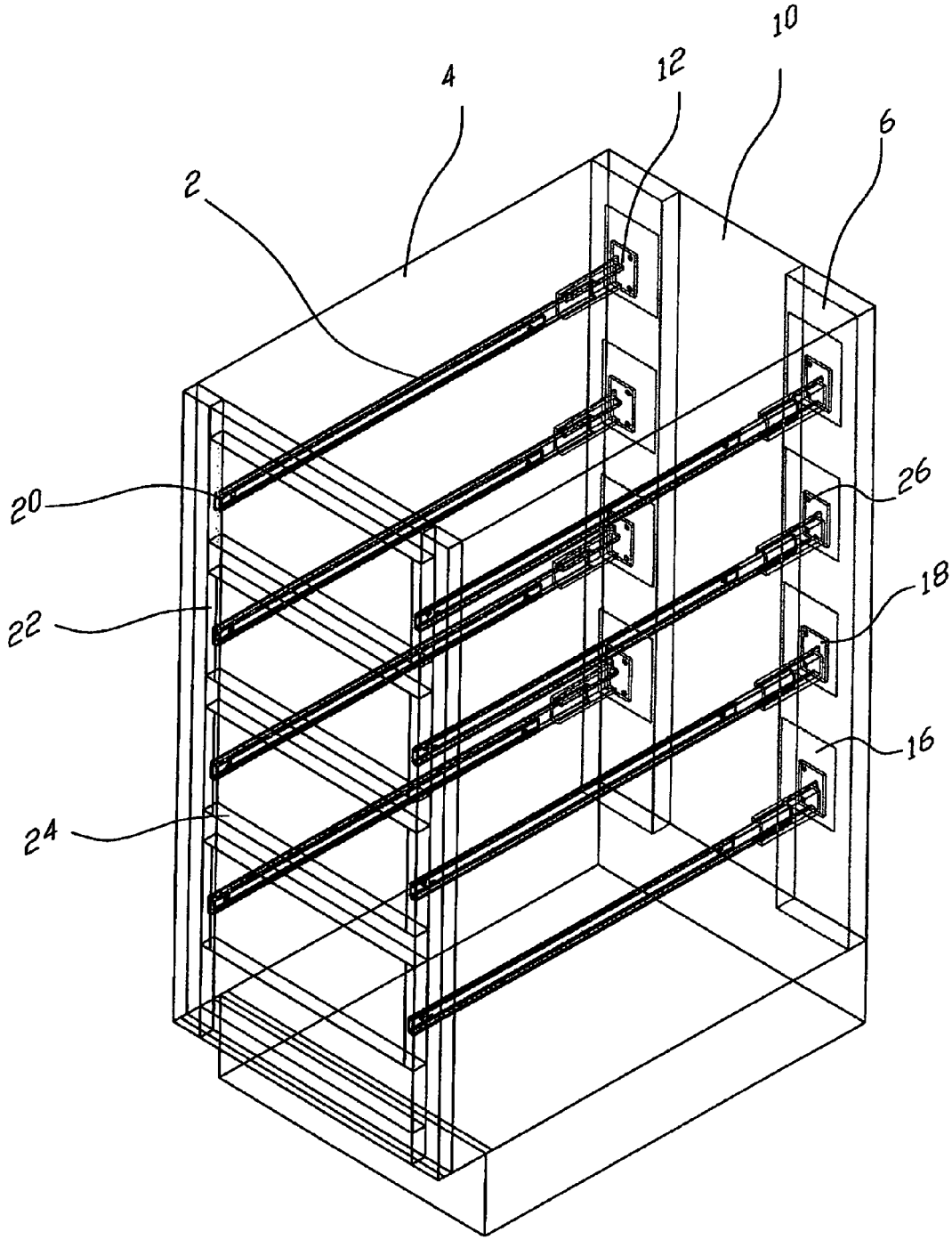
FIG. 3 is a cut-away elevational perspective view of a cabinet showing the drawer slides in place.

The present invention is useful for inserting drawer slides 2 wherever they may be needed. Inexhaustive examples of articles capable of receiving drawer slides are dressers, desks, cabinets, end tables, and buffets. In the following description, the term "article" will be used to refer to any and all articles 4 which can receive drawer slides 2.

The present invention allows a drawer slide 2 to be installed into an article 4 in its normal upright position in far less time than by using the prior art method.

Backing strips 6, preferably made of plywood or other appropriate substrate, are prepared such that there is a layer of multi-pole magnetic sheeting 8 laminated on a face side of the backing strips 6. The strips 6 are attached to the rear panel 10 of the article 4 where the rear mounting brackets 12 of the drawer slides 2 will attach. For each drawer 14, there are two such strips 6.

A piece of multi-pole magnetized sheeting 16 which has a conventional pressure-sensitive adhesive peel-and-stick removable cover on one side is attached to the rear end 18 of the rear mounting bracket 12 of each drawer slide 2. The multi-pole magnetic sheeting 16 is of such a size as to have sufficient magnetic attraction to hold the drawer slide 2 in place on the backing strip 6 yet permit orbital adjustment on the backing strip 6.

The front ends 20 of the drawer slides 2 are loosely attached to the front side surfaces 22 of a drawer opening 24 of the article 4 in such a way that the natural tendency of the drawer slides 2 is to hang down. The length of a drawer slide 2 is such that the multi-pole magnetized sheeting piece 16 will abut with the multi-pole magnetized sheeting 8 of the backing strip 6 when the drawer slides 2 are perpendicular to the backing strips 6. The rear ends 18 of the rear mounting brackets 12 are temporarily positioned on the backing strips 8.

A drawer 14 is inserted into the drawer opening of the article 4 causing the drawer slides 2 to assume their desired positions. In the desired positions, the multi-pole magnetized sheeting pieces 16 attached to the rear ends 18 of each rear mounting bracket 12 will abut with the multi-pole magnetized sheeting 8 laminated on the backing strips 8. When the drawer 14 is withdrawn, the drawer slides 2 maintain this desired position, held by magnetic force. It is then simple for the installer to attach each rear mounting bracket 12 to the magnetized backing strips 6 with screws 26. Each pair of magnetized backing strips 6 will service all the drawers 14 in any given row of an article 4.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A method of attaching drawer slides in an article capable of receiving drawer slides and having a rear panel and at least one drawer opening having front side surfaces, comprising, attaching backing strips containing multi-pole magnetized sheets laminated thereto to the rear panel of the article; providing drawer slides having front ends and rear ends having mounting brackets; attaching a piece of multi-pole magnetized sheeting of such a size as to have sufficient magnetic attraction to hold the drawer slide in place yet permit orbital adjustment on the backing strips to each of the rear mounting brackets; with the article in an upright position, loosely attaching the front ends of the drawer slides to the front side surfaces of the drawer opening; positioning the rear mounting brackets onto the backing strips; inserting a drawer into the drawer opening whereby the drawer slides assume the desired positions and are held in those positions by magnetic force between the multi-pole magnetized sheeting laminated to the backing strip and the multi-pole magnetized sheeting on the rear mounting brackets; removing the drawer; and attaching the rear mounting brackets to the backing strips.

2. The method of claim 1, wherein the backing strips are made of plywood.

3. The method of claim 1, wherein the brackets are attached to the backing strips with screws.

* * * * *